US006702522B2

(12) United States Patent
Silber

(10) Patent No.: US 6,702,522 B2
(45) Date of Patent: Mar. 9, 2004

(54) FOUNDATION FOR A TOWER AND A METHOD FOR ITS DEPLOYMENT ON SITE

(76) Inventor: Meir Silber, 3 Hogla Street, Rehovot 76329 (IL)

( * ) Notice: Subject to any disclaimer, the term of this patent is extended or adjusted under 35 U.S.C. 154(b) by 0 days.

(21) Appl. No.: 10/204,399

(22) PCT Filed: Feb. 25, 2001

(86) PCT No.: PCT/IL01/00174

§ 371 (c)(1),
(2), (4) Date: Aug. 22, 2002

(87) PCT Pub. No.: WO01/63056

PCT Pub. Date: Aug. 30, 2001

(65) Prior Publication Data

US 2003/0021636 A1 Jan. 30, 2003

(30) Foreign Application Priority Data

Feb. 24, 2000 (IL) ..... 134724

(51) Int. Cl.[7] ..... E02D 5/10
(52) U.S. Cl. ..... 405/229; 405/256; 52/295
(58) Field of Search ..... 405/229, 256, 405/244; 249/34; 52/295, 296

(56) References Cited

U.S. PATENT DOCUMENTS 1,647,925 A * 11/1927 May ..... 52/223.5
2,374,624 A * 4/1945 Schwendt ..... 52/223.5
4,561,231 A 12/1985 Hoyt et al.
4,707,964 A 11/1987 Hoyt et al.
4,899,500 A 2/1990 Miller et al.
4,912,893 A 4/1990 Miller et al.
4,951,433 A 8/1990 Miller et al.
5,063,719 A * 11/1991 Matsuo et al. ..... 52/296
5,134,828 A 8/1992 Baur
5,218,805 A * 6/1993 Rex ..... 52/295
5,233,809 A 8/1993 Gropper
5,257,489 A * 11/1993 Angelette ..... 52/295
5,379,562 A 1/1995 Hohmann
5,531,419 A 7/1996 Gustafsson et al.
5,746,036 A * 5/1998 Angelette ..... 52/295
5,802,792 A 9/1998 Fielding et al.
5,826,387 A * 10/1998 Henderson et al. ..... 52/295
5,890,332 A 4/1999 Skidmore et al.
6,098,357 A 8/2000 Franklin et al.
6,120,723 A 9/2000 Butler

* cited by examiner

*Primary Examiner*—Heather Shackelford
*Assistant Examiner*—Lisa M. Saldano
(74) *Attorney, Agent, or Firm*—James W. Kayden; Thomas, Kayden, Horstemeyer & Risley, LLP

(57) ABSTRACT

A foundation for a tower is formed of a plurality of prefabricated slabs coupled together so as to function as a monolithic foundation.

37 Claims, 6 Drawing Sheets

FOUNDATION FOR A TOWER AND A METHOD FOR ITS DEPLOYMENT ON SITE

FIELD OF THE INVENTION

The present invention relates to foundations for towers in general and, in particular, to a foundation for telecom towers and similar applications.

BACKGROUND OF THE INVENTION

In the implementation of a telecom network, a power transmission network or a similar network, first, sites are selected and planned, then building permits for the sites, including the tower sites, are obtained, and afterwards, the sites are built. In the conventional case, a concrete foundation is cast at the tower site. A normally prefabricated steel tower is assembled, erected and affixed to the foundation, in any of a number of known fashions, generally including screwing or bolting the tower base to the foundation. This provides a permanent tower facility, but takes a relatively long time to deploy, due to the fact that the foundation concrete must cure sufficiently to withstand the tower base loads before the tower can be erected and affixed to it.

Increasingly, new Telecom Networks (primarily mobile telephone networks) tend to be built under fast roll-out constraints. On the other hand, it is increasingly hard to obtain building permits for the sites (primarily the tower sites) of such networks.

Accordingly, there is a long felt need for, and it would be very desirable to have, a rapidly deployable telecom or similar tower, which would utilize a prefabricated foundation solution.

SUMMARY OF THE INVENTION

According to the present invention, there is provided a foundation for a tower, the foundation comprising a plurality of prefabricated slabs coupled together so as to function as a monolithic foundation.

According to one embodiment of the present invention the shape of the surface area of the foundation can be substantially square, rectangular, circular, octagonal or any other geometrical shape.

According to another embodiment of the present invention the foundation includes a plurality of layers, each layer including a plurality of adjacent slabs joined transversely to adjacent layers, wherein the thickness of each slab in a layer is substantially the same.

According to one embodiment of the invention the surface area of each slab is one half of the surface area of each said layer.

According to a preferred embodiment of the invention, each slab includes a plurality of horizontally spaced throughgoing substantially vertical bores for accepting long bolts or elongated connecting members having threaded at least end portions. Said bores further include lining sleeves.

According to yet another preferred embodiment of the invention, at least each slab at the bottom layer of said foundation, further comprises substantially vertical recesses at one end of said throughgoing vertical bores, wherein said recesses have a cross-section which is larger than the cross-section of said bores.

Further according to a preferred embodiment of the invention, the recesses have a specially shaped non-circular cross-section for housing said long bolts or connecting members, securing nuts, locking nuts, plate washers and non-rotating nut holding devices for preventing rotation of said connecting members when tightening said securing nuts.

According to a preferred embodiment, said recesses are arranged for snug fit housing of said heads of long bolts and securing nuts.

According to yet another preferred embodiment, said recesses further house non-rotating nut holding devices which have a non-circular cross section equal to or larger than the cross section of said securing and locking nuts, and are adapted to snug fit into said recesses and snug hold said locking nut, for preventing rotation of said connecting members. Said non-rotating nut holding devices comprise a substantially flat surface having surface area dimensions and contour suitable for snug fitting into said recesses, a circular hole suitable for inserting said connecting member and co-axial thereto, and two parallel walls projecting from said flat surface substantially perpendicularly thereto, wherein each wall is positioned at an equal distance from the center of said circular hole and spaced apart at a distance substantially equal to the length between two opposite ribs of said locking nuts for snug fit housing and holding of said locking nut. According to another preferred embodiment, said bottom layer slab further comprises a metal plate including holes co-axial with said recesses and bores, for distributing loads created by tensioning of said long bolts or connecting members and providing a support surface against which said heads of long bolts or securing nuts abut when said connecting members are tightened.

According to yet another preferred embodiment, all of said long bolts or connecting members or at least some of them, protrude from the top layer of the foundation for joining together all said layers of the foundation and connecting said tower to said long bolts or connecting members. According to still another preferred embodiment, each said layer includes slabs substantially similar to said bottom layer slab. According to one embodiment, the top layer includes slabs substantially similar to said bottom layer slabs turned upside down.

There is also provided in accordance with the present invention a method of preparing a foundation for a tower, the method comprising:

preparing prefabricated slabs including throughgoing substantially vertical bores for receiving elongated connecting members;

preparing a site having a desired area;

placing a first layer of said prefabricated slabs on the site;

placing a second layer of said prefabricated slabs transversely on said first layer, while;

aligning said throughgoing receiving bores; and joining together said first and second layers by means of said elongated connecting members passing through said aligned throughgoing receiving bores.

There is further provided in accordance with the present invention a method of preparing a foundation for a tower, further comprising placing additional layers of prefabricated slabs on said second layer and joining together all the layers by means of elongated connecting members passing through said aligned throughgoing bores in all the slabs.

The method according to another preferred embodiment of the present invention, further comprises placing prefabricated slabs having substantially vertical recesses at one end of said throughgoing vertical bores, at the bottom layer. According to a preferred embodiment, the method further comprises placing slabs substantially similar to said bottom layer slabs at any of the layers.

The method according to yet another preferred embodiment, further comprises placing slabs substantially similar to bottom layer slabs turned upside down at the top layer.

According to another preferred embodiment, said method further comprises the step of assembling onto bottom end portions of connecting members said securing nuts, said non-rotating nut holding devices and said locking nuts before inserting connecting members through said first layer, extending upwardly.

According to yet another preferred embodiment of the present invention, said method further comprises the step of inserting connecting members through said first layer, extending upwardly, before the step of placing the slabs of the first layer on the ground.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to a foundation for towers of telecom sites, power transmission lines, and the like, which facilitates rapid deployment due to the fact that the foundation is completely prefabricated. Except for a possible thin layer of lean concrete, which has no structural significance, no other on site casting is required in order to form a solid, stable foundation for the tower. Thus, one purpose of the invention is to provide a solution for the tower sites of telecom and similar networks that require rapid deployment due to fast roll-out constraints.

The foundation according to the invention is formed of a plurality of prefabricated slabs. The heart of the invention is the method used to connect together the components of the foundation, and make them function effectively and safely as if they were one monolithic foundation. The foundation according to the invention can be permanent, or can be removable after temporary deployment, as preferred by the network builder. It is a particular feature of the invention that the foundation is very big and heavy in its entirety, so as to provide stability for the tower, yet its components can be prefabricated in dimensions and weights which are transportable by conventional means.

Figure 1:
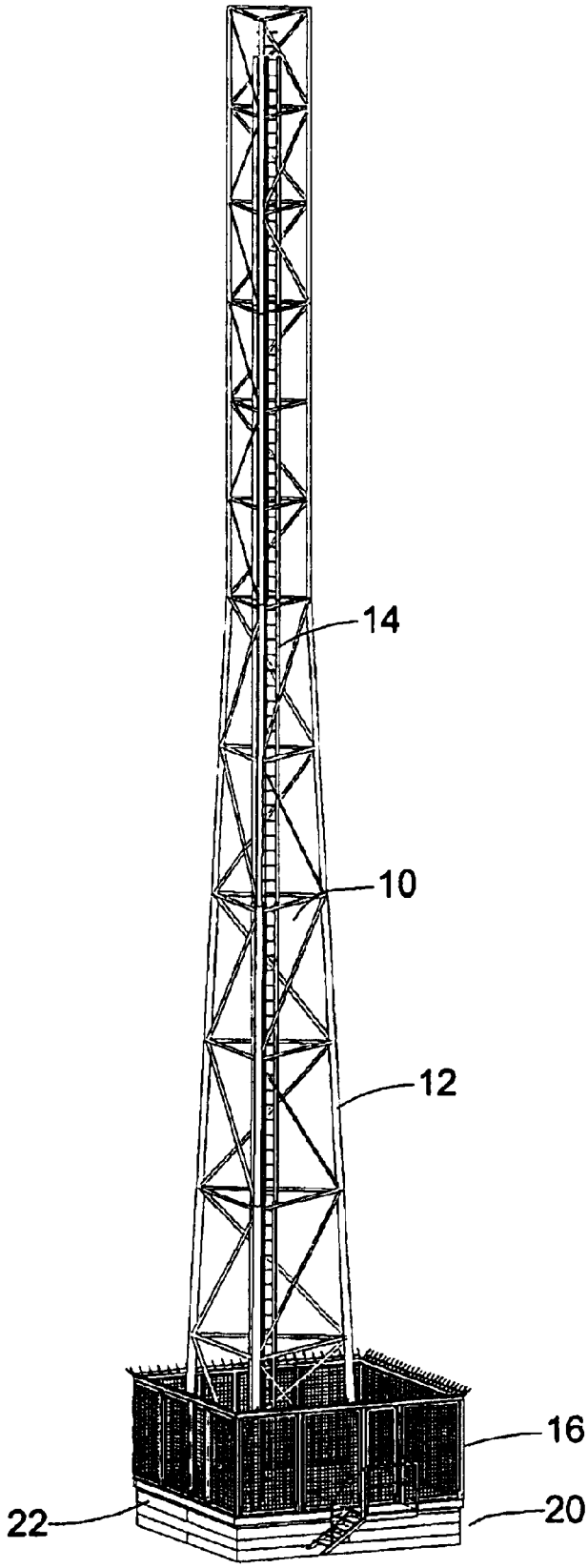
FIG. 1 is a perspective view of a tower mounted on a foundation constructed and operative in accordance with one embodiment of the present invention.
Figure 2:
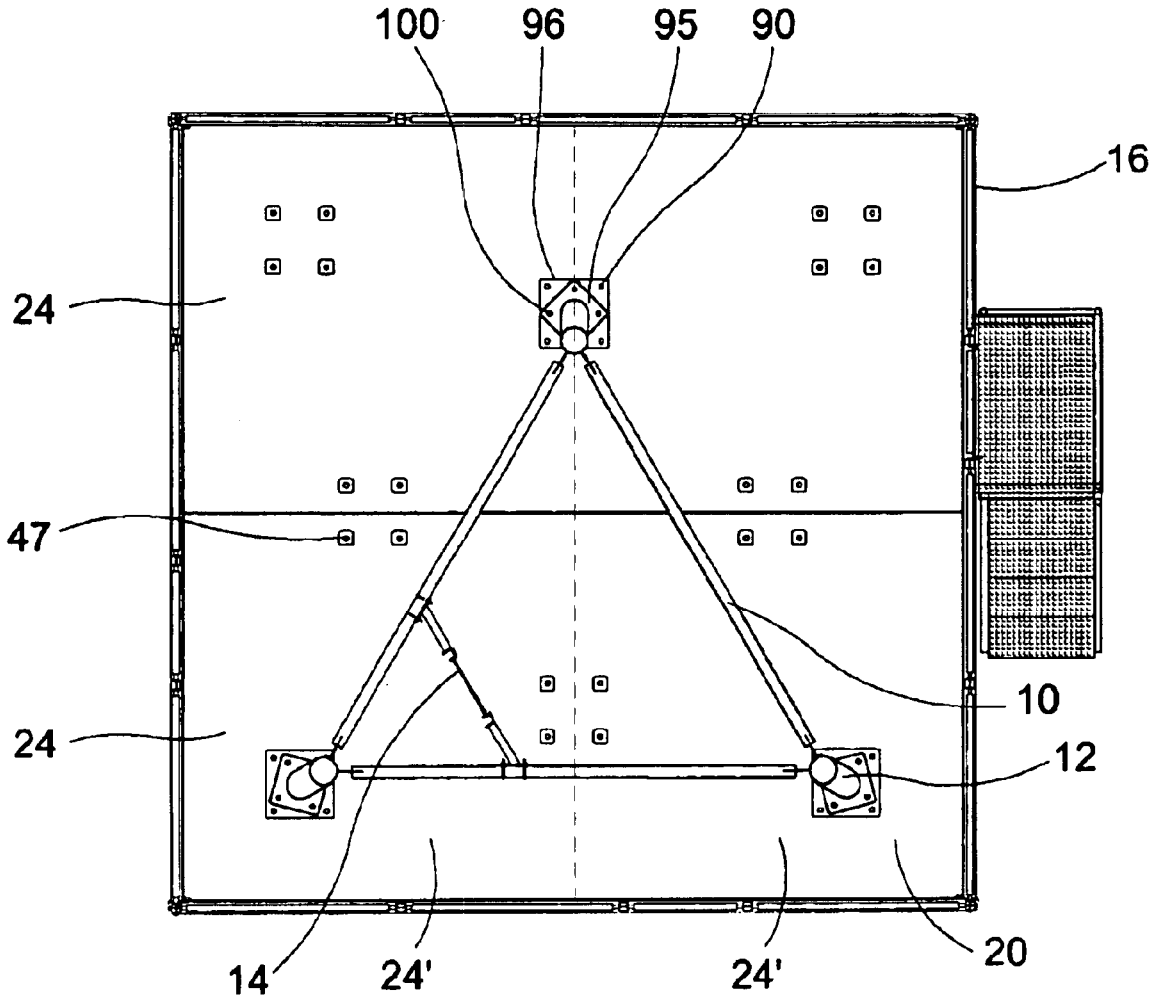
FIG. 2 is a schematic plan view of the tower of FIG. 1.

Referring now to FIGS. 1 and 2, there are shown respective perspective and plan views of a tower foundation and tower constructed and operative in accordance with one embodiment of the present invention. As can be seen, a conventional prefabricated tower 10 is mounted on a foundation 20. Tower 10 can be any telecom tower or similar tower requiring a firm foundation to carry and stabilize it. Tower 10 can be of various conventionally required shapes (i.e. Lattice Tower or Monopole type), heights, or dimensions. The tower illustrated in FIGS. 1 and 2 is a Lattice Tower with three legs 12, which are affixed to the foundation 20, as described below. A ladder 14 for climbing the tower, and a fence 16 or other security measures, may be optionally provided, as known.

The tower foundation according to the present invention is formed of several layers 22, preferably at least four layers, as illustrated in FIGS. 1 and 2. Each of the layers consists of at least two concrete slabs 24 (rectangular if the foundation is substantially square). It will be appreciated that each layer of the foundation according to the present invention consists of a plurality of slabs that are either identical or not identical in surface area shape and dimensions, depending on engineering choices or constraints. Also, the slabs of each layer may differ in surface area shape and dimensions from one layer to another. However, the slabs in each layer must be of suitable surface area dimensions and shape to cover the overall area of that layer, and the thickness of each slab within a given layer must be substantially equal. Still, the thickness of each layer may vary, also depending on engineering choices or constraints. It will be further appreciated that the surface area of the foundation according to the present invention can be of various geometrical shapes, such as substantially square, rectangular, circular, octagonal, etc.

Figure 9:
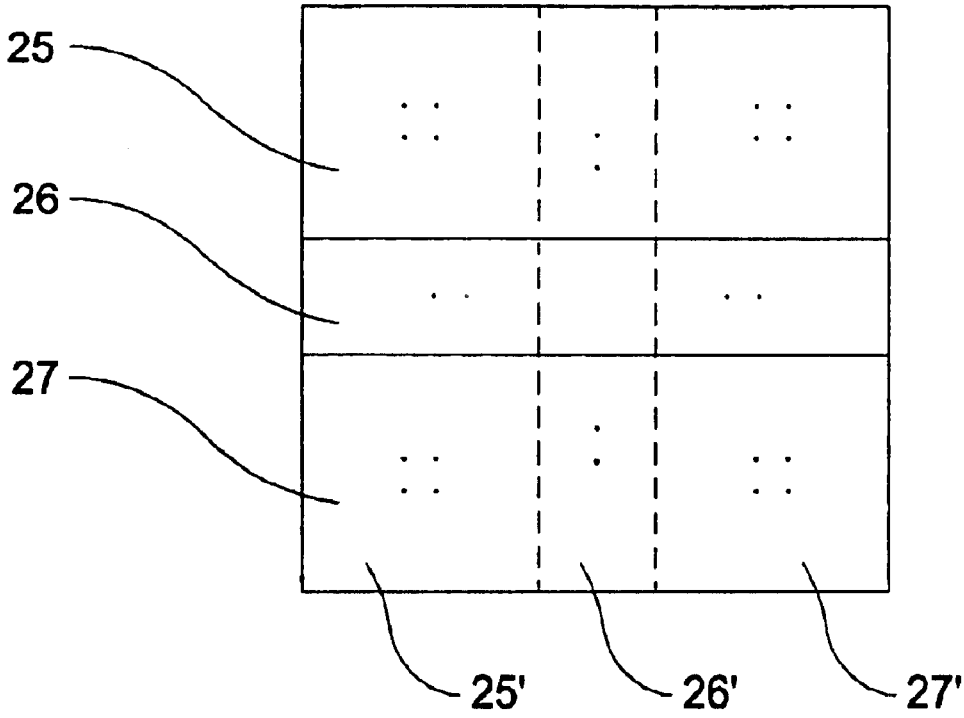
FIG. 9 is a plan view of two layers of the foundation constructed and operative in accordance with an alternative embodiment of the invention.

Referring now to FIG. 9, there is shown a substantially square foundation wherein each layer consists of 3 rectangular slabs 25, 26 and 27, which can differ from one another in surface area dimensions. Slabs 25 and 27 have different dimensions than slab 26, and slabs 25 and 27 may be identical or not identical.

Figure 10:
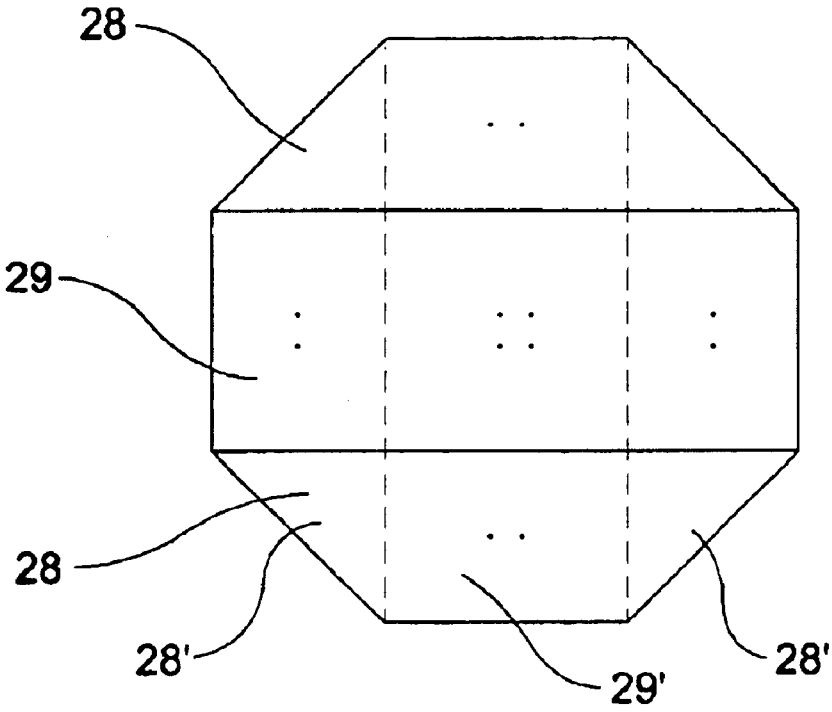
FIG. 10 is a plan view of two layers of the foundation constructed and operative in accordance with an alternative embodiment of the invention.

Referring now to FIG. 10, there is shown a substantially octagonal foundation wherein each layer consists of 3 slabs. Slabs 28 are identical but are of different surface area dimensions and shape from slab 29. During the process of assembling the foundation on site, the slabs are stacked in layers in a criss-cross fashion, so that their long dimensions are arranged in alternating transverse directions. Thus, in FIG. 2, the two slabs 24 of the top most layer are indicated by a solid line, while the slabs 24' of the layer beneath it are indicated by a broken line. In FIG. 9, slabs 25, 26 and 27 of the top most layer are indicated by a solid line, while the slabs 25', 26' and 27' of the layer beneath it are indicated by a broken line. In FIG. 10, slabs 28 and 29 of the top most layer are indicated by a solid line, while the slabs 28' and 29' of the layer beneath it are indicated by a broken line. When the slabs are all tightly fastened together, they form a monolithic "Raft" type foundation for the tower.

Figure 3:
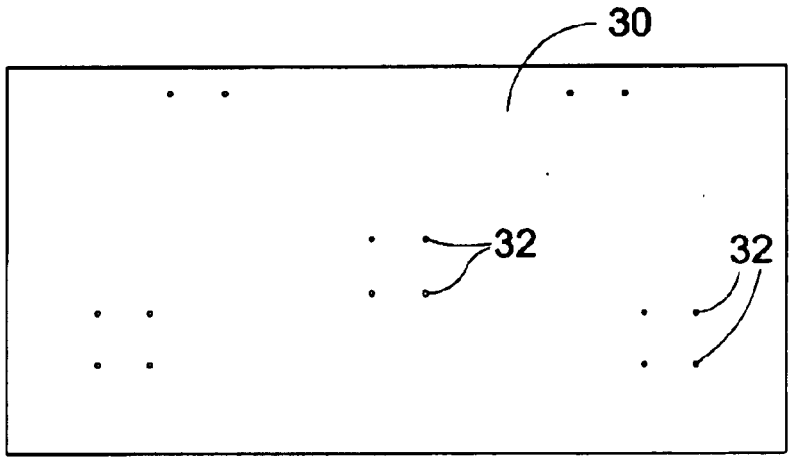
FIG. 3 is a plan view of a slab constructed and operative in accordance with one embodiment of the invention.
Figure 4:
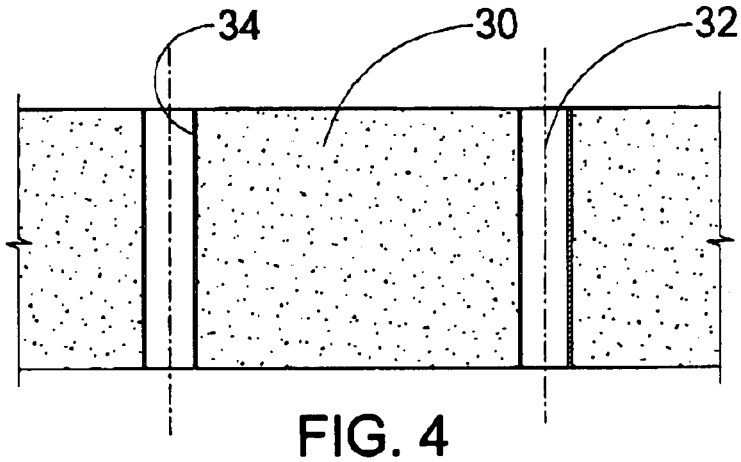
FIG. 4 is a partial sectional view of the slab of FIG. 3.

Referring now to FIG. 3, there is shown a plan view of a slab 30 constructed and operative in accordance with one embodiment of the invention. Slab 30 is an elongate slab having a pre-selected dimensions and thickness, which depend on the design constraints of the particular tower. A plurality of substantially vertical throughgoing bores 32 are provided through slab 30, as seen in FIGS. 3 and 4. Bores 32 are arranged to allow long bolts or elongated connecting members which may be threaded or have threaded end portions, to pass through said bores 32 for coupling the slabs of all the layers together. Bores 32 are preferably lined with a metal or other liner or sleeve 34 during casting, so as to facilitate accurate placing of all designed bores 32 in the slab. Accurate placing of the bores is imperative for alignment of each respective bore 32 in all the layers of the foundation, thus allowing insertion of said long bolt or elongated connecting member through respective bore 32 of all the layers. Typically slab 30 is for use in layers of the foundation other than the bottom layer.

Figure 5:
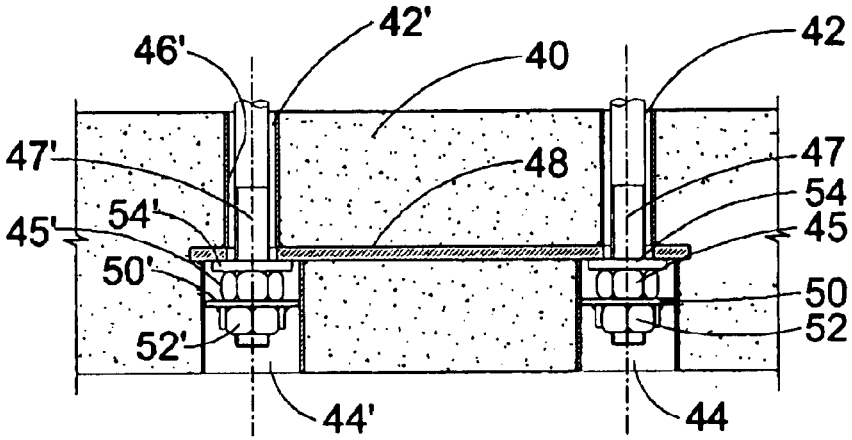
FIG. 5 is a partial sectional view of a bottom slab with recesses and bottom end portions of elongated connecting members, constructed and operative in accordance with an alternative embodiment of the invention.
Figure 11:
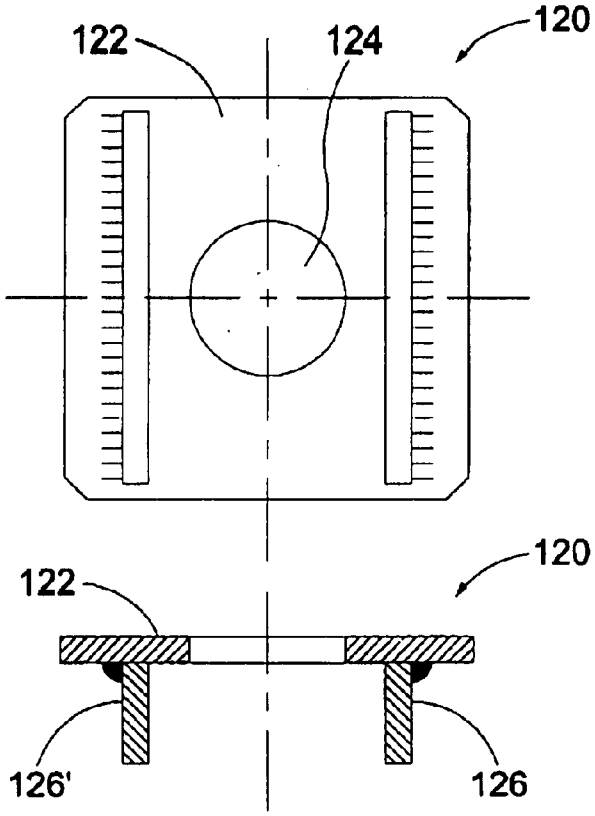
FIG. 11 illustrates the non-rotating nut holding device, constructed and operative in accordance with an alternative embodiment of the invention.

Referring to FIG. 5, there is shown a sectional view of a bottom slab 40 including the bottom end portions of the long bolts or elongated connecting members 47 and 47', constructed and operative in accordance with an alternative embodiment of the invention. According to a preferred embodiment of the invention, slab 40 turned upside down can be used at the top layer as well as at the bottom layer. Although not necessarily economical, slab 40 can also be utilized as any internal layer. Slab 40 includes throughgoing bores 42 and 42' merging into specially shaped and substantially vertical cylindrical recesses of non-circular cross-section 44 and 44' at one end of bores 42 and 42', respectively. According to a preferred embodiment, recesses 44 and 44' are shaped and sized for snug fit housing and holding of the bottom heads of the long bolts or of securing nuts 45 and 45' screwed on to the end portions of elongated threaded connecting members 47 and 47', which are inserted into bottom slab 40 and extend upwardly for connecting the layers of the foundation. Alternatively, the recesses may be shaped and sized for snug fit housing and holding of non-rotating nut holding devices 50 and 50', which have a non-circular cross section equal to or larger than the cross section of the securing nuts 45 and 45' and locking nuts 52 and 52', and are adapted to snug hold the locking nuts. Referring to FIG. 11, there is shown a non-rotating nut holding device 120, comprising a substantially flat surface 122 having surface area dimensions and contour suitable for snug fitting into the recesses 44 and 44' in slab 40, and a circular hole 124 having a diameter which is equal to or larger than the diameter of connecting member 47 and 47' and is co-axial with the connecting members, recesses 44 and 44' and bores 42 and 42'. Non-rotating nut holding device 120 further comprises two parallel walls 126 and 126' projecting from flat surface 122 substantially perpendicularly thereto, and each wall is positioned at an equal distance from the center of circular hole 124 and spaced apart at a distance substantially equal to the length between two opposite ribs of the locking nuts for snug fit housing and holding of said locking nuts, thus preventing the nuts from rotating.

Also, the recesses prevent the ends of said bolts or connecting members 47 and 47' from protruding downwards from the lower surface of the bottom layer. This feature of said recesses is imperative for even contact between the underside of the foundation and the soil sub-base prepared for erection of the foundation and thus for even load distribution of the weight of the foundation and tower on said sub-base.

Preferably, only the recesses in the slabs of the bottom layer need have a non-circular cross section of compatible shape and size of the bolt head or securing nut in the absence of access to these bottom heads or nuts. According to a preferred embodiment, the recesses can be of non-circular substantially cylindrical shape and size, through which the securing nuts can be indirectly held. As shown in FIG. 5, recesses 44 and 44' can have a substantially cylindrical non-circular cross section larger in size than the securing nuts 45 and 45'. According to this embodiment, elongated connecting members which may be threaded or have threaded end portions are used to join the layers of the foundation. When threaded connecting members 47 and 47' are used, before they are inserted into bottom slab 40, securing nuts 45 and 45' are screwed on to the bottom end portions of the connecting members, with or without plate washers 54 and 54'. Thereafter, non-rotating nut holding devices 50 and 50', are slipped, respectively, onto bottom end portions of connecting members 47 and 47' followed by locking nuts 52 and 52' which are screwed on to the bottom end portions of the connecting members, abut against non-rotating nut holding devices 50 and 50' and slide them up along the connecting members until they abut against securing nuts 45 an 45'. Once non-rotating nut holding devices 50 and 50' are locked between locking nuts 52 and 52' and securing nuts 45 and 45', the top portions of connecting members 47 and 47' are inserted respectively into recesses 44 and 44' and bores 42 and 42' of bottom slab 40, and securing nuts 45 and 45', non-rotating nut holding devices 50 and 50' and locking nuts 52 and 52' are placed in recesses 44 and 44', respectively. Thus, when securing nuts 74 and 74' are screwed on the end portions of the connecting members (shown in FIG. 7) for joining together all the layers of the foundation, non-rotating nut holding devices 50 and 50' abut against recesses 44 and 44' respectively and prevent the rotation of connecting members 47 and 47'. It will be appreciated, that locking non-rotating nut holding devices 50 and 50' between locking nuts 52 and 52' and securing nuts 45 and 45', respectively, can also be accomplished by tightening securing nuts 74 and 74' which may rotate connecting members 47 and 47', respectively, until locking nuts 52 and 52' cause non-rotating nut holding devices 50 and 50' to abut against securing nuts 45 an 45', thus preventing further rotation of the connecting members.

According to an alternative embodiment, wherein recesses 44 and 44' snug fit bottom heads of the long bolts or of securing nuts 45 and 45', the locking nuts or non-rotating nut holding devices or both, may not be required. According to this embodiment, long bolts or connecting members 47 and 47', which have threaded end portions only, can be used to join the layers of the foundation. Thus, when these connecting members are used, securing nuts 45 and 45', with or without plate washers 54 and 54', are screwed on to the bottom end portions of the connecting members before their top end portions are inserted into bottom slab 40. When securing nuts 74 and 74' are tightened, connecting members 47 and 47', respectively, may rotate until securing nuts 45 and 45' reach the end of the threaded bottom end portion of the connecting members, thus preventing them from further rotation. When long bolts are used, no securing nuts are required at their bottom portions and their top end threaded portions are inserted into the recesses in bottom slab 40 and extend upwardly while their heads are snug fitted in recesses 44 and 44' which prevent the rotation of the long bolts when securing nuts 74 and 74' are tightened.

Non-rotating nut holding devices 50 and 50' are shaped so that, when inserted into recesses 44 and 44', any rotation of non-rotating nut holding devices 50 and 50' is prevented. It will be appreciated by those skilled in the art that the alternative arrangements described above are preferred for the bottom most layer of the foundation, on top of which all the other layers are placed, and to which there is no access once the slabs are in place.

The depth of recesses 44 and 44' from the bottom end of slab 40 is substantially smaller than the thickness of said slab but sufficiently deep to prevent the long bolts or connecting members from protruding downwards from the bottom layer.

Figure 6:
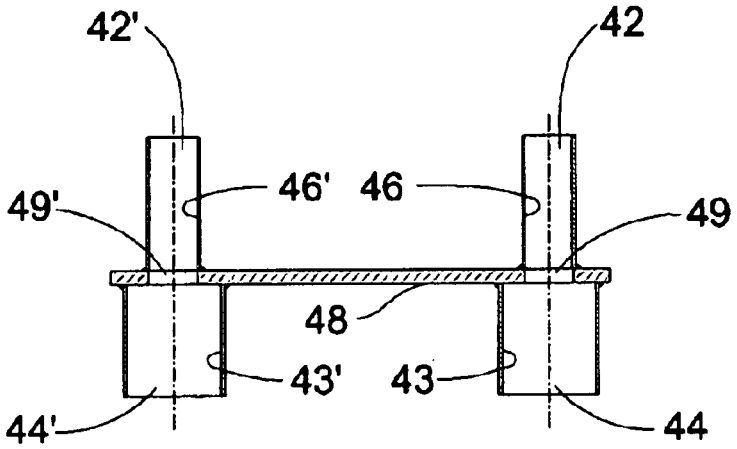
FIG. 6 is a sectional view of a preferred metal liner for the bores and recesses shown in FIG. 5, constructed and operative in accordance with a preferred embodiment of the invention.

The bores and recesses are formed during the casting of slab 40, preferably through use of a metal "cast-in" type liner, one embodiment of which is more clearly illustrated in FIG. 6. Said liner may be provided in individual segments, each forming a single bore and a single recess in the casted slab. Preferably, the lining of said bores and recesses is formed by grouping together a large number of bores and recesses. Such grouping together of two horizontally spaced apart bores and recesses is illustrated in FIGS. 5 and 6. Grouping of more than two bores and recesses can be accomplished in the same manner.

Referring now to FIG. 6, there is shown a base plate 48 including holes 49 and 49' of a diameter equal to the diameter of bores 42 and 42', respectively, and located directly thereunder. Bore liners or sleeves 46 and 46', for forming bores 42 and 42' respectively, are attached on one side of plate 48 and larger substantially cylindrical recess liners or sleeves 43 and 43' for forming recesses 44 and 44', respectively, are attached on the other side of plate 48. Liners or sleeves 43 and 43', 46 and 46' and holes 49 and 49' are arranged, respectively, substantially co-axially; the two axes being spaced apart at a pre-selected distance. Metal plate 48 serves also as a base against which the securing nuts or heads of the long bolts abut directly or through washers or plate washers 54 and 54', as known in the art and as shown in FIG. 5. Thus, plate 48 serves to distribute the concentrated loads created by the tensioning of the long bolts or elongated connecting members.

A plurality of selected long bolts or elongated connecting members must protrude upward from the top surface of the top layer for connecting the tower to the foundation, whereas the remaining long bolts or connecting members, preferably, do not protrude from said top surface.

Figure 7:
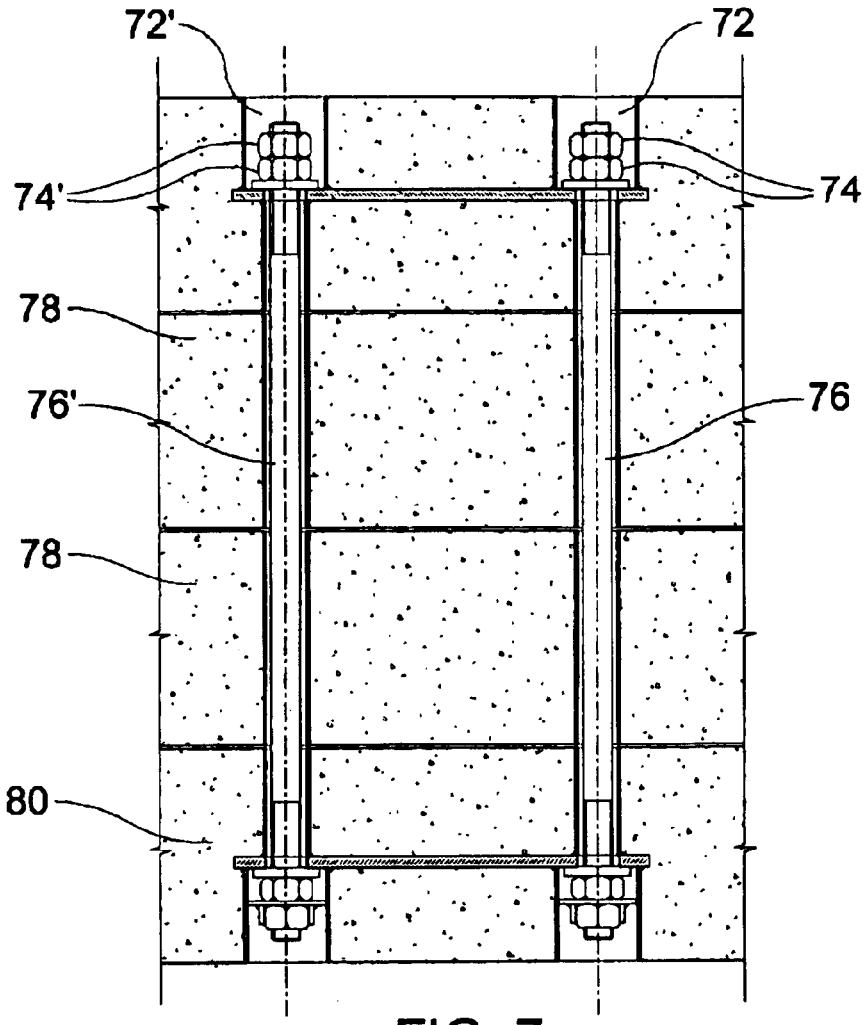
FIG. 7 is a partial sectional view of the foundation constructed and operative in accordance with an alternative embodiment of the invention.

Now referring to FIG. 7, there is shown one preferred embodiment of the invention, wherein a bottom slab turned upside down is used to form the top layer. In this embodiment, recesses 72 and 72' are sized to allow the use of a fastening tool, such as a deep ring-wrench or the like, for tightening the securing nuts 74 and 74' on top of said non-protruding long bolts or connecting members 76 and 76'. The recesses 72 and 72' in the top layer, which house, respectively, said non-protruding long bolts or connecting members 76 and 76', may be filled in with any type of grout material, if desired, to provide a smooth upper surface finish for the foundation. FIG. 7 further shows a partial cross section of internal layers 78, bottom layer 80 and full length of non-protruding long bolts or connecting members 76 and 76'.

Figure 12:
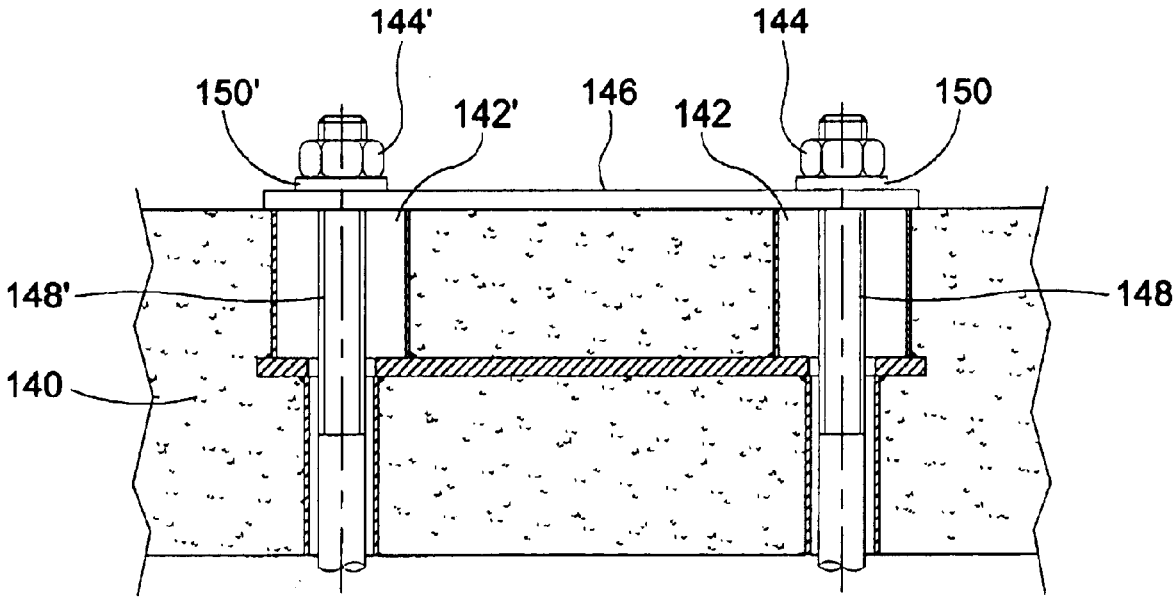
FIG. 12 is a partial sectional view of the upper part of the foundation, constructed and operative in accordance with an alternative embodiment of the invention.

In another preferred embodiment shown in FIG. 12, a bottom slab 140 is turned upside down and used as a top layer of the foundation. According to this embodiment, the size of recesses 142 and 142' does not allow the insertion and use of a fastening tool for tightening securing nuts 144 and 144' inside the recesses. Thus, there is provided a plate 146 comprising a plurality of holes having a diameter which is equal to or greater than the diameter of connecting members 148 and 148' and arranged substantially co-axially with the long bolts or connecting members which are inserted through said holes in plate 146. Securing nuts 144 and 144' are screwed on to the top end portion of connecting members 148 and 148' and abut against plate 146 directly or indirectly through plate washers 150 and 150', when tightened.

Figure 8:
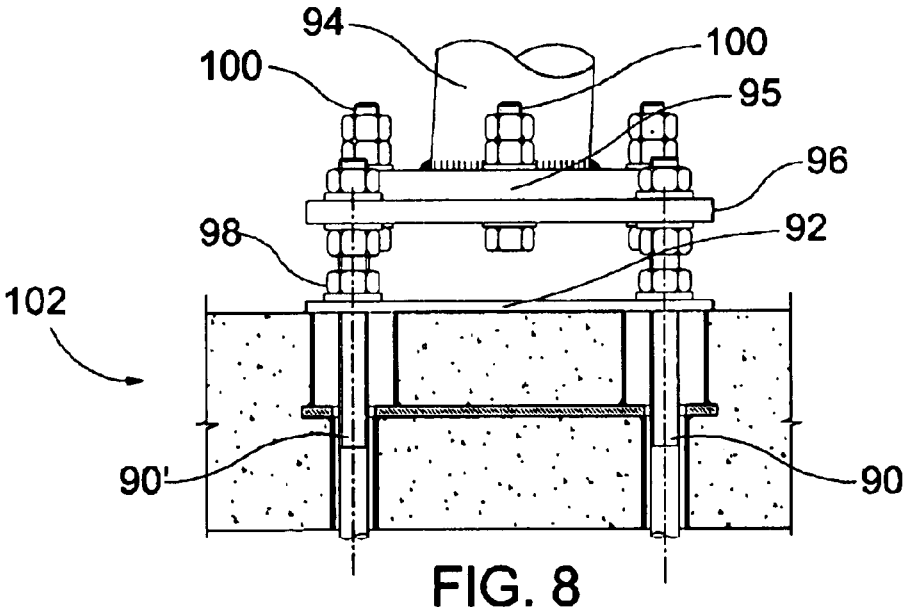
FIG. 8 is a partial sectional view of the upper part of the foundation and partial sectional view of a leg of a tower and structural interface element, constructed and operative in accordance with an alternative embodiment of the invention.

Now referring to FIG. 8, as aforesaid, some of the throughgoing long bolts or elongated connecting members 90 and 90' are utilized to affix the base plate 95 of the leg of the tower, either directly or indirectly to the long bolts or connecting members. As known in the art, due to design, manufacturing or construction imperfections, it is generally impossible or very difficult, to affix base plate 95 directly to the long bolts or connecting members. Thus, in the embodiment seen in FIG. 8 (as well as in FIG. 2), leg 94 of the tower is engaged to a structural interface element 96 by conventional bolts 100. In turn, said interface element 96 is affixed to the long bolts or connecting members 90 and 90', which also serve to couple the layers of the foundation underneath. Thus it may be further appreciated that the long bolts or connecting members can vary in length, whereas long bolts or connecting members 90 and 90' will be longer while used to affix the base of the tower to the foundation then the others which have no such role. There are further shown in FIG. 8 the top ends of the long bolts or connecting members protruding from slab 102, which is a bottom layer slab turned upside down. Also seen in FIG. 8 are ends of long bolts or connecting members 90 and 90' secured by securing nuts 98 which abut optionally against plate 92 and secure the joining of the foundation layers by securing plate 92. Conventional bolts 100 are used for affixing interface element 96 to leg 94. It will be appreciated by those skilled in the art, that the coupling of the tower to the foundation is shown in FIG. 8 by way of an example only.

The dimensions of the slabs can vary somewhat, according to the type and size of the tower to be supported, the size of the site, and the design standards and norms required to be followed in the specific country in which the site is to be erected. Preferably, the foundation is symmetrical in the horizontal plane, e.g., square or circular, to permit ease of fabrication and layering in the transverse orientation, and since the direction of the force acting on the tower (e.g., wind or earthquake) cannot be normally predicted. The foundation can, alternatively, be asymmetrical. Most preferably, the foundation is substantially square and the slabs are standardized for groups of towers having similar construction requirements. The horizontal dimensions of the slabs should normally be limited by the constraints of conventional transportability (i.e. width and length not exceeding those of conventional truck pallets). Preferably, the foundation according to the present invention comprises at least 4 layers, whereas the thickness of the slabs is determined by the overall design of the "Raft" type foundation and by constraints of the weight of each slab, which is a function of its thickness. On one hand, the thickness of the slab cannot be less than a minimum thickness that provides the required stiffness of the slab, and on the other hand, it cannot exceed a maximum thickness that will raise the weight of each slab beyond the capacity of locally available cranes.

Once the dimensions of the foundation, the number of layers, the number, shape and thickness of the slabs, and the number and location of bores for the long bolts or connecting members, have been decided upon (all depending upon construction calculations), the required slabs can be prefabricated. When it is desired to deploy the tower in a specific site, preparation works need to be done according to the conditions of the site, including soil conditions. Said site preparation works are normally limited to shallow excavation (normally up to 50 cm), compaction of the natural soil bed and backfill with granular material compacted in two or three layers. Thus, the preparation works take only a short while. For permanent deployment, casting a thin, well-leveled layer of lean concrete on top of the compacted sub-base is preferable. The prefabricated slabs are then transported to the construction site, and rapidly assembled to form the finished foundation. The long bolts or connecting members 47, washers 54, nuts 45, locking washers 50 and locking nuts 52 are assembled together and inserted into the recesses, holes and bores of slabs 40 of the bottom most layer (FIG. 5), from underneath the slabs while they are securely held at an appropriate height above the ground, before it is laid down in its final position. The middle and upper layers are carefully placed transversely over the preceding layers, while being laced onto the upwardly projecting long bolts or connecting members 76 (FIG. 7) and 90 (FIG. 8). When the top most layer is laid, securing nuts are applied and tightened onto the threaded top end portions of long bolts or connecting members 76 and 90. Thereafter, the tower itself can be assembled, erected and secured onto said selected protruding long bolts or connecting members 90. When it is desired to remove the tower and its foundation, this process can be reversed. Alternatively, if the tower site is permanent, recesses in top slab 40 are preferably filled with any type of grout material.

It will be appreciated that the invention is not limited to what has been described hereinabove, merely by way of example. Rather, the invention is limited solely by the claims, which follow.

What is claimed is:

1. A foundation for a tower having a surface of a substantially regular geometric shape, said foundation comprising:

a plurality of prefabricated slabs arranged in a plurality of layers to be assembled on site and joined together so as to function as a monolithic foundation;

a plurality of elongated connecting members that transversely couple said plurality of layers, one end portion of each of said connecting members being threaded and the other end portion of each of said connecting members being one of: an integral bolt-head type end enlargement and a threaded end portion; and a plurality of top and bottom securing arrangements for securing said respective elongated connecting members in said plurality of prefabricated slabs thereby joining said plurality of prefabricated slabs together so as to function as a monolithic foundation, wherein each of said layers includes:

a plurality of adjacent slabs having substantially equal thickness, and each of said slabs including a plurality of bores passing therethrough for accepting said elongated connecting members, and each of the bottom layer slabs further including a plurality of non-circular cylindrical recesses, wherein each of said recesses is located at the bottom end of a respective said bore, is extending to the bottom surfaces of the respective said slab, has a cross-section that is larger than the cross-section of the respective said bore, and is shaped for snug fit housing of at least a portion of a respective said bottom securing arrangement, and wherein said securing arrangements and said elongated connecting members are configured to be installed in said slabs when said foundation is being assembled on site.

2. The foundation according to claim 1, wherein each of said securing arrangements includes one of: a securing nut mounted onto said threaded end of the respective said elongated connecting member and said integral bolt-head type end enlargement of the respective said elongated connecting member.

3. The foundation according to claim 2, wherein any of said recesses are modified such that the cross-section of each of said modified recesses is substantially larger than the cross-section of the respective one of said securing nut and said integral bolt-head type end enlargement, yet has two substantially opposite walls with a small enough clear distance there between, such that, when the respective one of said securing nut and said integral bolt-head type end enlargement is housed within said modified recess, its rotation about its axis is prevented.

4. The foundation according to claim 2, wherein said recesses are arranged for snug fit housing of the respective one of said securing nuts and said integral bolt-head type end enlargements.

5. The foundation according to claim 2, wherein any of said recesses are further modified such that the cross-section of each of said further modified recesses is substantially larger than the cross-section of the respective one of said securing nut and said integral bolt-head type end enlargement, and wherein each of the respective said bottom securing arrangements further includes a non-rotating holding device comprising a substantially flat surface shaped for a substantially snug fit housing in the respective said recess, and having a circular hole sized and located suitably for inserting said connecting member therethrough, and two parallel walls projecting from said flat surface substantially perpendicular thereto, said walls being positioned at substantially equal distances from the center of said circular hole and spaced apart distantly enough to allow placement of the respective one of said securing nut and said integral bolt-head type end enlargement therebetween yet close enough to ensure that, when placed between said walls, rotation of the respective one of said securing nut and said integral bolt-head type end enlargement about its axis is prevented.

6. The foundation according to claim 5, wherein at least one of the dimensions of any said flat surfaces of said non-rotating holding devices is substantially smaller than the cross-section dimensions of the respective said modified recess, and wherein the shapes of the cross-sections of said respective modified recess and said flat surface are configured so that, when the non-rotating holding device is inserted into said modified recess, rotation of said non-rotating holding device about the axis of the bore associated with said modified recess is prevented.

7. The foundation according to claim 2, wherein said elongated connecting members are arranged in a configuration that is both end portions being threaded end portions and wherein said bottom securing arrangements further include locking nuts positioned on the bottom end portions of said elongated connecting members having said securing nuts mounted on said threaded ends within said recesses, whereby tightening of said locking nut against said securing nut on any of said elongated connecting members serves to prevent rotation of said elongated connecting member relative to the respective said securing nut, thereby further preventing rotation of said elongated connecting member about its axis.

8. The foundation according to claim 2, wherein each of said bottom layer slabs further includes a metal plate imbedded therein, each of said metal plates including holes co-axial with said bores, for distributing loads created by tensioning of said elongated connecting members and for providing a support surface against which said securing arrangements abut when tightened.

9. The foundation according to claim 1, wherein the top layer of said plurality of layers includes slabs substantially similar to said bottom layer slabs, inverted so that said recesses are located at the top end of respective said bores and extend to the top surfaces of the respective said top layer slabs.

10. The foundation according to claim 9, wherein a first predetermined subset of said elongated connecting members are terminated and tightened within said top recesses of said top layer slabs and wherein a second predetermined subset of said elongated connecting members protrude from said top layer so as to allow all said layers in said foundation to be coupled together and further to receive and connect the bottom of the tower to said foundation.

11. The foundation according to claim 9, wherein all of said elongated connecting members protrude from said top layer so as to allow all said layers in said foundation to be coupled together and further to receive and connect the bottom of the tower to said foundation.

12. The foundation according to claim 9, wherein all said slabs of all said layers are substantially similar to those of said bottom layer.

13. The foundation according to claim 1, wherein said elongated connecting members are arranged in a configuration that is one of:

a lower end portion being an integral bolt-head type end enlargement and an upper end portion being a threaded end portion;

a lower end portion being a threaded end portion and an upper end portion being an integral boit-head type end enlargement; and both end portions being threaded end portions.

14. The foundation according to claim 1, wherein said bores include lining sleeves.

15. The foundation according to claim 1, wherein said recesses include lining sleeves.

16. The foundation according to claim 1, wherein said securing arrangements further include plate washers positioned on said elongated connecting members within said recesses.

17. For use with a foundation for a tower having a surface of a substantially regular geometric shape and including a plurality of prefabricated slabs arranged in a plurality of layers to be assembled on site, joined together so as to function as a monolithic foundation, and and a plurality of elongated connecting members, one end portion of each being threaded and the other end portion of each being one of: an integral bolt-head type end enlargement and a threaded end portion, that transversely couple the plurality of layers, wherein the prefabricated slabs have a plurality of bores passing therethrough for accepting the elongated connecting members, and each of the bottom layer slabs further has a plurality of non-circular cylindrical recesses each located at the bottom end of a respective bore, extending to the bottom surface of the respective slab, and having a cross-section that is larger than the cross-section of the respective bore, and having a predetermined shape, a plurality of bottom securing arrangements for securing the respective elongated connecting members in the plurality of prefabricated slabs which, together with top securing arrangements, join the plurality of prefabricated slabs together so as to function as a monolithic foundation, wherein at least a portion of selected members of the plurality of said bottom securing arrangements are shaped for snug fit housing in the recesses of the bores of the bottom slabs, and wherein said bottom securing arrangements and the elongated connecting members are configured to be installed in the slabs when the foundation is being assembled on site.

18. The bottom securing arrangements according to claim 17, wherein each of said securing arrangements includes one of: a securing nut mounted onto the threaded end of the respective elongated connecting member and the integral bolt-head type end enlargement of the respective elongated connecting member.

19. The bottom securing arrangements according to claim 18, wherein any of the recesses are modified such that the cross-section of each of said modified recesses is substantially larger than the cross-section of the respective one of said securing nut and said integral bolt-head type end enlargement, yet has two substantially opposite walls with a small enough clear distance there between, such that, when the respective one of said securing nut and said integral bolt-head type end enlargement is housed within said modified recess, its rotation about its axis is prevented.

20. The bottom securing arrangements according to claim 18, wherein the recesses are arranged for snug fit housing of the respective one of said securing nuts and said integral bolt-head type end enlargements.

21. The bottom securing arrangements according to claim 18, wherein any of the recesses are further modified such that the cross-section of each of said further modified recesses is substantially larger than the cross-section of the respective one of said securing nut and said integral bolt-head type end enlargement, and wherein said bottom securing arrangement further includes a non-rotating holding device comprising a substantially flat surface shaped for a substantially snug fit housing in the respective recess, and having a circular hole sized and located suitably for inserting the connecting member therethrough, and two parallel walls projecting from said flat surface substantially perpendicular thereto, said walls being positioned at substantially equal distances from the center of said circular hole and spaced apart distantly enough to allow placement of the respective one of said securing nut and said integral bolt-head type end enlargement therebetween yet close enough to ensure that, when placed between said walls, rotation of the respective one of said securing nut and said integral bolt-head type end enlargement about its axis is prevented.

22. The bottom securing arrangements according to claim 21, wherein at least one of the dimensions of any of said flat surfaces of said non-rotating holding devices is substantially smaller than cross-section dimensions of the respective said modified recess, and wherein the shapes of the cross-sections of said respective modified recess and said flat surface are configured so that, when the non-rotating holding device is inserted into said modified recess, rotation of said non-rotating holding device about the axis of the bore associated with said modified recess is prevented.

23. The bottom securing arrangements according to claim 17, wherein said bottom securing arrangements include securing and locking nuts positioned on those end portions of the elongated connecting members having said securing nuts mounted on their threaded ends within the recesses, whereby tightening of said locking nut against said securing nut on any of the elongated connecting members serves to prevent rotation of the elongated connecting member relative to the respective said securing nut, thereby further preventing rotation of the elongated connecting member about its axis.

24. The bottom securing arrangements according to claim 17, wherein said securing arrangements further include plate washers positioned on the elongated connecting members within the recesses.

25. A method of preparing a foundation for a tower, said method including the steps of:

Forming a plurality of layers of a substantially regular geometric shape, made up of adjacent slabs having substantially equal thickness and having a plurality of bores which are aligned to pass through the plurality of layers when they are assembled on site into a foundation for a tower;

Preparing elongated connecting members to transversely couple the layers when inserted in the bores, the elongated connecting members comprising one of: threaded rods and long bolts;

Fashioning respective top and bottom securing arrangements for securing the respective elongated connecting members in the slabs of the layers thereby joining the plurality of layers together so as to function as a monolithic foundation for a tower, the securing arrangements and the elongated connecting members being configured to be installed in the slabs when the foundation is being assembled on site;

Fabricating one layer to form a bottom layer wherein each bore of the slabs further has a non-circular cylindrical recess located at its bottom end extending to the bottom surface of the respective slab, having a cross-section that is larger than the cross-section of the respective bore and shaped for snug fit housing of at least a portion of a respective bottom securing arrangement;

Preparing a site to accommodate the foundation to be assembled;

Installing bottom securing arrangements in the recesses of the bores of the bottom layer;

Placing said bottom layer slabs in their planned final position on the prepared site, while keeping the installed bottom securing arrangements in place in said recesses;

Placing a second layer of the prefabricated slabs transversely on the bottom layer, aligning the bores therethrough for subsequent passage of the elongated connecting members;

Placing subsequent layers of the prefabricated slabs transversely on the already placed layers, aligning the bores therethrough for subsequent passage of the elongated connecting members;

Inserting said elongated connecting members downwardly, through said bores of the slabs, such that the bottom ends of said elongated connecting members are housed within said recesses and engage the bottom securing arrangements (so that their rotation about their axis is prevented);

Completing the coupling of the layers together, so as to function as a monolithic foundation, by tightening the top ends of the elongated connecting members against the top surface of the top layer slabs, using the top securing arrangements.

26. The method according to claim 25, wherein said steps of forming, preparing, fashioning, and fabricating may be performed in any order.

27. The method according to claim 25, wherein, said step of fashioning, the bottom securing arrangements include one nut and a non-rotating holding apparatus.

28. The method according to claim 27, wherein, in said steps of fashioning and fabricating, the non-rotating holding apparatus is one of:

the recess in the bottom layer, shaped to house said nut and engage it in a manner preventing its rotation about its axis; and a non-rotating holding device comprising a substantially flat surface shaped for a substantially snug fit housing in the respective recess, and having a circular hole sized and located suitably for inserting the elongated connecting member therethrough, and two parallel walls projecting from said flat surface substantially perpendicular thereto, said walls being positioned at substantially equal distances from the center of the circular hole and spaced apart distantly enough to allow placement of the at least one nut therebetween, and preventing rotation about its axis.

29. The method according to claim 25, wherein said step of fabricating includes fabricating a layer to form a top layer includes slabs substantially similar to those of the bottom layer slabs, inverted so that the recesses are located at the top end of respective bores and extend to the top surfaces of the respective top layer slabs, said method further including, after said step of placing subsequent layers, the step of placing the top layer of the prefabricated slabs transversely on the uppermost of the already placed layers, aligning the bores therethrough for subsequent passage of the elongated connecting members.

30. The method according to claim 25, wherein the top securing arrangements include one of: a nut, a securing and locking nut pair and an integral bolt-head type end enlargement of the respective elongated connecting member.

31. A method of preparing a foundation for a tower, said method including:

Forming a plurality of layers of a substantially regular geometric shape, made up of adjacent slabs having substantially equal thickness and having a plurality of bores which are aligned to pass through the plurality of layers when they are assembled on site into a foundation for a tower;

Preparing elongated connecting members to transversely couple the layers when inserted in the bores, the elongated connecting members comprising one of: threaded rods and long bolts;

Fashioning respective top and bottom securing arrangements for securing the respective elongated connecting members in the slabs of the layers thereby joining the plurality of layers together so as to function as a monolithic foundation for a tower, the securing arrangements and the elongated connecting members being configured to be installed in the slabs when the foundation is being assembled on site;

Fabricating one layer to form a bottom layer wherein each bore of the slabs further has a non-circular cylindrical recess located at its bottom end extending to the bottom surface of the respective slab, having a cross-section that is larger than the cross-section of the respective bore and shaped for snug fit housing of at least a portion of a respective bottom securing arrangement;

Preparing a site to accommodate the foundation to be assembled;

Inserting said elongated connecting members upwardly, through said bores of the bottom layer slabs, such that the securing arrangements at the bottom ends of said elongated connecting members are housed within said recesses and are engaged therein so that their rotation about their axis is prevented;

Placing said bottom layer slabs in their planned final position on the prepared site, while keeping the inserted elongated connecting members in place, projecting upwardly;

Placing a second layer of the prefabricated slabs transversely on the bottom layer, aligning the bores therethrough, thereby allowing the upwardly projecting elongated connecting members to pass through the bores of the second layer slabs;

Placing subsequent layers of the prefabricated slabs transversely on the already placed layers, aligning the bores therethrough, thereby allowing the upwardly projecting elongated connecting members to pass through the bores of the subsequent layer slabs; and Completing the coupling of the layers together, so as to function as a monolithic foundation, by tightening the top ends of the elongated connecting members against the top surface of the top layer slabs, using the top securing arrangements.

32. The method according to claim 31, wherein said steps of forming, preparing, fashioning, and fabricating may be performed in any order.

33. The method according to claim 31, further including, after said step of preparing a site, the step of arranging ready assemblies of said elongated connecting members together with said bottom securing arrangements.

34. The method according to claim 31, wherein the bottom securing arrangements include one of: a nut, a securing and locking nut pair and an integral bolt-head type end enlargement of the respective elongated connecting member.

35. The method according to claim 34, wherein said steps of fashioning and fabricating, include a non-rotating holding apparatus which is one of:

the recess in the bottom layer, shaped to house said nut and engage it in a manner preventing its rotation about its axis; and a non-rotating holding device comprising a substantially flat surface shaped for a substantially snug fit housing in the respective recess, and having a circular hole sized and located suitably for inserting the elongated connecting member therethrough, and two parallel walls projecting from said flat surface substantially perpendicular thereto, said walls being positioned at substantially equal distances from the center of the circular hole and spaced apart distantly enough to allow placement of at least one nut therebetween, and preventing rotation about its axis.

36. The method according to claim 31, wherein, in said step of fashioning, each of the bottom securing arrangements includes at least one nut and is fitted to a non-rotating holding apparatus.

37. The method according to claim 31, wherein said step of fabricating includes fabricating a layer to form a top layer includes slabs substantially similar to those of the bottom layer slabs, inverted so that the recesses are located at the top end of respective bores and extend to the top surfaces of the respective top layer slabs, said method further including, after said step of placing subsequent layers, the step of placing the top layer of the prefabricated slabs transversely on the uppermost of the the already placed layers, aligning the bores therethrough for subsequent passage of the elongated connecting members.

* * * * *